United States Patent [19]

Labbe et al.

[11] Patent Number: 4,718,842

[45] Date of Patent: Jan. 12, 1988

[54] AUTOMATIC PRESS FOR CONTROLLING THE FORCE ON EACH MOVABLE PLATE

[76] Inventors: Philippe Labbe, 40, avenue de la Dame Blanche, 94120 Fontenay-Sous-Bois; Patrick Reynier, 24-26, rue Sibuet, 75012 Paris, both of France

[21] Appl. No.: 774,305

[22] Filed: Sep. 10, 1985

[30] Foreign Application Priority Data

Sep. 11, 1984 [FR] France ..... 84 13934

[51] Int. Cl.[4] ..... B30B 9/28

[52] U.S. Cl. ..... 425/149; 264/40.5; 425/150; 425/354; 425/406

[58] Field of Search ..... 264/40.3, 40.5, 40.7, 264/40.1; 425/135, 140, 149, 150, 151, 154, 162, 167, 352, 354, 406, 411, 450.1; 192/129 R, 129 B, 143

[56] References Cited

U.S. PATENT DOCUMENTS

| | | | |
|---|---|---|---|
| 3,407,710 | 10/1968 | Weiss . | |
| 3,951,042 | 4/1976 | Weiss . | |
| 3,956,973 | 5/1976 | Pomplas . | |
| 4,411,150 | 10/1983 | Klein et al. | 72/461 |
| 4,413,967 | 11/1983 | Burry | 425/149 |
| 4,447,198 | 5/1984 | Long et al. | 425/150 |

FOREIGN PATENT DOCUMENTS

| | | | |
|---|---|---|---|
| 0008520 | 3/1980 | European Pat. Off. . | |
| 0048776 | 4/1982 | European Pat. Off. . | |
| 1512271 | 12/1967 | France . | |
| 1585502 | 1/1970 | France . | |
| 59-31127 | 2/1984 | Japan | 425/149 |
| 1234978 | 6/1971 | United Kingdom . | |
| 2077957 | 12/1981 | United Kingdom . | |

*Primary Examiner*—Jay H. Woo
*Assistant Examiner*—J. Fortenberry
*Attorney, Agent, or Firm*—Fay, Sharpe, Beall, Fagan, Minnich & McKee

[57] ABSTRACT

An automatic press includes a first plate (2, 5), which is movable in translation along an axis, and a hydraulic jack (7), of which a piston (6) is secured to the first plate. The hydraulic jack commands the translation movement of the first plate to bring it into a first predetermined position (A) in relation to a reference postion (R1). The jack (7) is supported by a frame (3, 4, 8, 9). The press includes also a second plate (10, 12, 13), which supports an object (30) to be pressed; this second plate is situated facing the first plate. The jack (7) includes a mechanism (41) for bringing into control the position of the plate with the set predetermined position (A), and an opto-electronic member (16) for referencing the momentary positions of the first plate in the course of its movement. The automatic press has application to the manufacture of objects by pressing and also to welding done by bringing the plates together.

2 Claims, 5 Drawing Figures

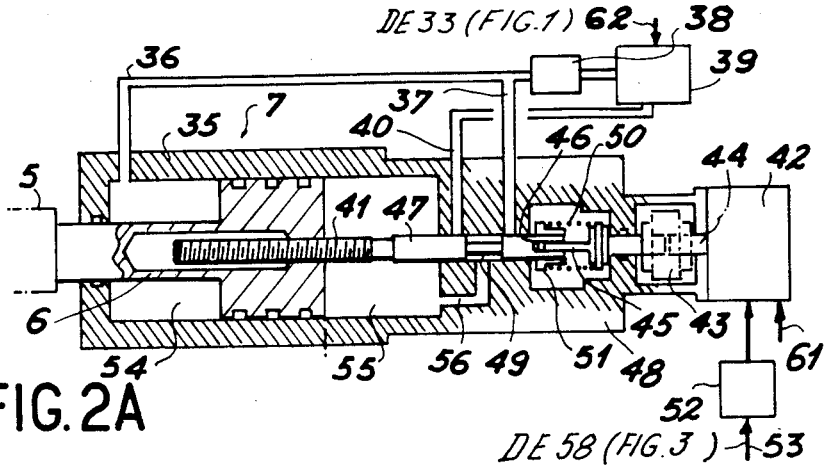
FIG. 2A
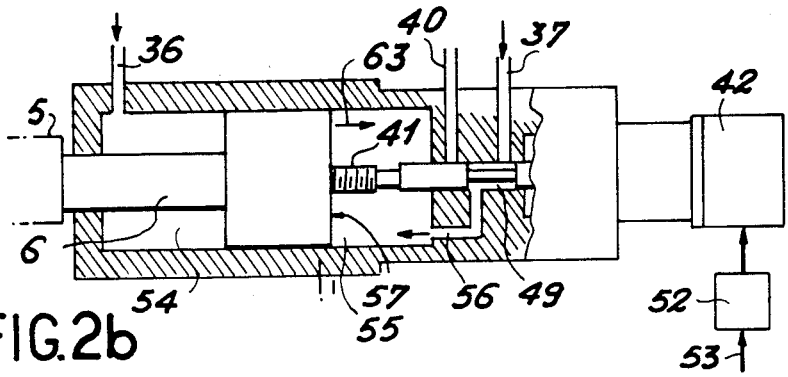
FIG. 2b
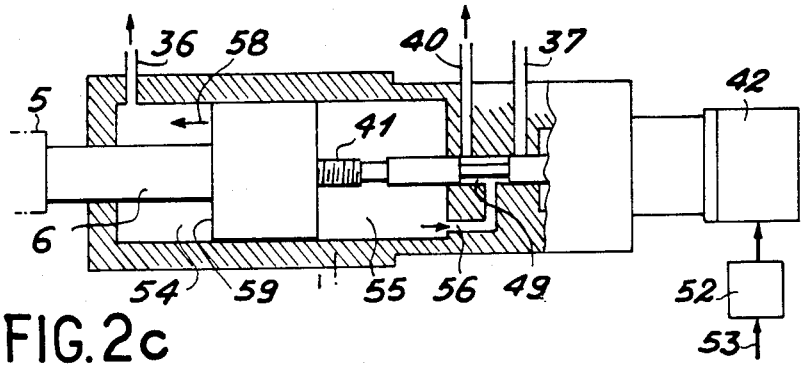
FIG. 2c
FIG. 3
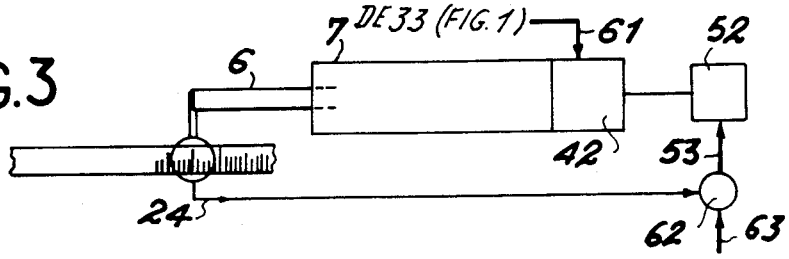

AUTOMATIC PRESS FOR CONTROLLING THE FORCE ON EACH MOVABLE PLATE

BACKGROUND AND SUMMARY OF THE INVENTION

This invention relates to an automatic press, this press being used, in particular for the manufacture of compact parts by sintering a powder. It is applied also, to the formation of any object for which the dimensions obtained by the pressing operations must have great precision. More precisely, the automatic press of the invention includes two plates of which at least one is movable in translation along an axis by the action of a jack the position of which is controlled in relation to a predetermined set position. The pressure exerted by the piston of the jack on the plate is, itself, also controlled by control means.

No press is known at present for which it is possible to control simultaneously and with precision, the position of the movable plate or plates comprising it, as well as the force exerted by jacks on the object.

Presses are known in which it is only possible to control the forces of pressure exerted on the plates, but is not possible to control simultaneously the exact positions of the plates. Presses are also known (with screw, for example), in which it is only possible to control the positions of the plates, but is not possible to control simultaneously the pressure forces exerted on these plates.

The purpose of the invention is to remedy these defects and, in particular, to obtain an automatic press in which there can be controlled simultaneously the positions of movable plates as well as the forces exerted on these plates by the jacks which command their movements.

The invention has for its subject an automatic press, which includes a first plate, movable in translation, parallel to a vertical axis, and a hydraulic jack of which the piston, which is secured to the first plate, commands the translation movement of the latter to bring it into a predetermined position, referenced in relation to a reference position which in turn is fixed in relation to the frame, along the vertical axis, this jack being supported by a frame. The press also includes a second plate which supports an object to be pressed, this second plate being situated facing the first plate. The jack includes means for controlling the position of the plate to the predetermined set position, and opto-electronic means for referencing the momentary positions of the first plate in the course of its movement, these opto-electronic means being connected to the control means of the jack commanding the movement of the plate.

According to another characteristic of the present invention, the second plate is also a plate movable in translation parallel to the vertical axis. The second plate is integral with or secured to the piston of another hydraulic jack, the piston of this other jack commanding the movement of this second plate to bring it into another predetermined set position, referenced in relation to a reference position, fixed in relation to the frame. The other jack is supported by the frame, and includes other means for controlling the position of the second plate with this other predetermined position. Other opto-electronic means for referencing the momentary positions of the second plate in the course of its movement are connected to other control means of this other jack which commands the movement of the second plate.

According to another characteristic of the present invention, the first and the second plates include, respectively, force detectors supplying, respectively, signals indicating the forces exerted on the first and second plates, during the pressing or during the distancing of the plates, these detectors being connected to means for controlling these forces. The jacks are connected to these control means to stop the movement of the plate for which the force indicated by the detector is greater than a predetermined limit force.

According to another characteristic of the present invention, the opto-electronic control means are HEIDENHAIN coders.

BRIEF DESCRIPTION OF THE DRAWINGS

The characteristics and advantages of the present invention will appear more clearly from the description which follows, given in reference to the attached drawings, in which:

FIGS. 2A, 2B, 2C represent schematically longitudinal sections of one of the hydraulic jacks commanding the movement of the plates in the press of FIG. 1, for different positions of the plate. Some of the means controlling the position of the piston of the jack appear in these figures; and, FIG. 3 represents schematically a control circuit of a jack used in the press of the invention.

DETAILED DESCRIPTION OF THE PREFERRED EMBODIMENT

Figure 1:
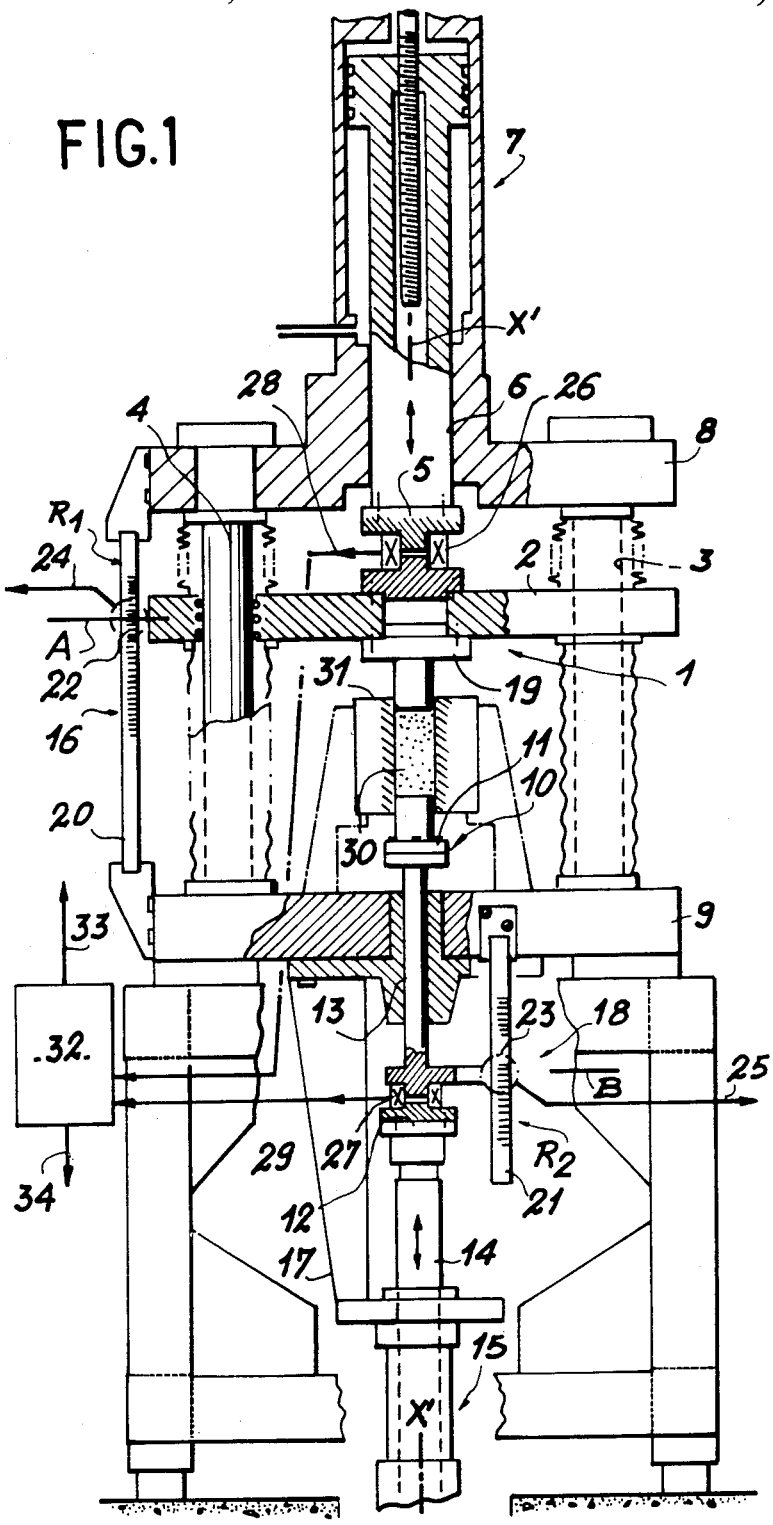
FIG. 1 represents schematically and in partial longitudinal section, an automatic press according to the invention.

FIG. 1 shows in diagram a longitudinal section of the automatic press of the invention. This press includes a first plate 1, movable in translation parallel to (i.e. along) a vertical axis X'X'. This first movable plate may consist, for example, of a guide piece 2, resting on four bearing columns 3, 4, connected by the cross piece 5. The part 19 is the pressing tool itself. The cross piece 5 permits connecting the assembly of the first plate 1 with the piston 6 of the jack 7. This piston commands the translation movement of the plate parallel to the axis X'X'. This movement brings the first plate into a predetermined position A, in relation to a reference position R1, along the vertical axis X'X'. R1 is a fixed position in relation to the part 9.

The jack 7 is supported by a frame including two parts 8, 9 integral with or secured to columns 3, 4. The positioning between the parts 8 and 9 and the columns is known and very precise. The part 9 is the reference of the position control system. This press includes also a second plate 10, which faces the first plate 1. This second plate is connected, to at least one cross piece 12 by the guide stem 13. The cross piece 12 is secured to or integral with the piston 14 of another hydraulic jack 15. The second plate 10 can be held in an immobile position if the pressing operation requires it. The part 11 forms part of the pressing tool.

As will be seen in detail later on, the jack 6 which commands the movements of the first plate includes internal hydro-mechanical means for controlling the position of the latter, with a predetermined set position; it is associated with opto-electronic means 16 for referencing the momentary positions of the first plate during its movement. These opto-electronic means are connected to the control means of the jack.

In the same way, the piston 14 of the other jack 15 commands the movement of the second plate to bring it into another predetermined set position B, referenced in relation to another reference position R2. R2 is a fixed position in relation to the part 9. This other jack is supported by an intermediate part 17 and by the part 9 of the frame of the machine. The stem 13 of the plate 10 is guided in the part 9 of the frame.

The hydraulic jack 15 also includes other internal hydro-mechanical means, which will be described in detail later on, to control the position of the second plate 10 in another predetermined programmed position. Other opto-electronic means 18 permit the referencing of the momentary positions of the second plate during its movement. These other opto-electronic means are connected to the means of control of the jack 15.

The opto-electronic means 16, 18, which permit marking the momentary positions A, B of the plates 1, 10, in relation to reference positions R1, R2, each consist of HEIDENHAIN coders. These coders, known to those skilled in the art, consist of graduated linear rulers 20, 21, associated with photoelectric detectors 22, 23. These detectors supply a pulse for each passage before a graduation of the ruler. The photoelectric detectors give, at their outlets 24, 25, signals representing the momentary positions A and B of the plates, in relation to the reference positions R1, R2. These signals are applied to the control means of the corresponding jacks, as will be seen later.

The plates 1, 10 also include force detectors 26, 27; these detectors give, at their outlets 28, 29, signals indicating the force exerted on the first and second plates, during the pressing of an object 30 or during the distancing of the plates. In the example shown in the Figure, the object 30 may be obtained, for example, by sintering a powder contained in the mold 31. The outlets 28, 29 of the detectors are connected to control means 32. These control means permit stopping the movement of each plate when the force indicated by the detector is greater than a predetermined limit force. The control means will not be described in detail here, since they may consist simply of adjustable detectors of voltage threshold, well known in the art, these detectors receiving signals 28, 29 proportional to the forces exerted on each of the plates. The outlets 33, 34 of the control means 32 correspond to the outlets of these threshold detectors and permit commanding the jacks, as will be seen in detail later on.

The automatic press shown in FIG. 1 may be single-action high: in this case, only the first (upper) plate 1 is moved downward while the second (lower) plate 10 is held in a fixed position. The automatic press may also be a single-action low: in this case, only the second, or lower, plate 10 is moved upward, while the first, upper, plate 1 is held in a fixed position.

Finally, the press may be double action: in this case, the two plates move in the direction of the mold 31. The second, lower, plate 10 may, after pressing, serve to eject the object 30 obtained in the mold 31.

If, for technical reasons, the object obtained by sintering must have opposite parts of different compacting, it is essential that the pressures and thus the forces exerted by the pistons on the plates, are different. Let us say, for example, that a maximum force of 25 tons can be developed by the piston 6 of the first plate 1, and a maximum force of 8 tons by the piston 14 of the jack 15 of the second plate 10. In this case, when the press is used in double acion, it is evident that the force of 25 tons which could be developed by the piston 6, must be limited to 8 tons. The role of the force detectors is then essential since they permit, through the control means 32 acting on the jack 7 commanding the first plate, the control of the jack so that the jack will not exert a force greater than 8 tons (the maximum force developed by the jack 15 of the second plate 10).

FIGS. 2A, 2B and 2C represent schematically and in longitudinal section the jack 7, provided with internal hydro-mechanical means, which commands the movement of the piston 1, through the piston 6. These Figures represent the jack 7, for different positions of the piston within the cylinder. They show also a part of the means for control of the position of the piston in relation to the predetermined programmed position A defined above. It is quite evident that the jack 15, commanding the movement of the second plate 10, has not been shown. This jack, as well as the hydro-mechanical control means associated with it, are constituted in the same way as the jack 7 and its associated control means.

As shown in FIG. 2A, the main chamber 35 of the cylinder of the jack is fed with fluid under pressure; this fluid is applied selectively on one face or on the other of the piston 6, as will be seen in detail farther on, through two pipes 36, 37, connected to a hydraulic pump 38, which is fed by a fluid reservoir 39. The return of the fluid under pressure to the reservoir 39 takes place through the pipe 40.

The means of control of the position of the piston or the plate with the predetermined programmed position, are partly shown in this Figure. These means include a threaded stem 41, engaging in the piston 6. This stem 41 permits, by its rotation, its movement in relation to the piston, to the right or to the left of the Figure. This movement is commanded by a DC motor 42, acting on coupling means 43 of the motor shaft 44 and of a shaft 45 connected to the stem 41. The stem 41 is guided in a bore 46. The screw 41 at its end forms, within a cross piece 48, an annular chamber 49. The spring 50, which is supported against the part 51, permits absorbing the movements of the piston to the right or left of the Figure, when the motor 42 drives the threaded stem 41 in rotation in one direction or the other. The motor 42 is commanded by known commutation means 52, which will not be described in detail here. These commutation means receive at an entrance 53 a command voltage coming from a comparator of the control circuit, which will be described in connection with FIG. 3. This comparator receives a signal, representing the momentary position A of the piston, supplied by opto-electronic means 16, as well as a signal representing the predetermined or programmed position.

The volume 54 of the main chamber of the cylinder 35 is put in communication with the pump through the pipe 36; the volume 55 of this main chamber is put in communication with the pump through the pipes 37 and 56, in a manner which will be described farther on in detail. In the same way, the volume 55 may be put in communication with the reservoir 39, through the pipes 40 and 56.

In FIG. 2A, it is assumed that the piston 6 is in a position of equilibrium within the cylinder 35. This equilibrium corresponds to the case where the piston occupies the predetermined programmed position. The annular chamber 49 is then situated between the pipes 40 and 37. Under these conditions, the return of the fluid to the reservoir 39, through the pipes 56 and 40, cannot take place, and the pressure of the fluid coming from the pump 38 cannot be applied in the volume 55 of the main chamber 35, through the pipes 37 and 56. This equilibrium of the position of the piston is reached when the commutation means 52 receive at their entrance 53, a comparison signal of zero. This signal, coming from the comparator of the control circuit, results from equality between the signal representing the predetermined or programmed position and the signal representing the momentary position of the piston.

In FIG. 2B, the same elements bear the same references as in FIG. 2A. To simplify this Figure, the pump 38 and the reservoir 39 are not shown. It is assumed here that the DC motor 42 has received from the commutation means 52, a signal commanding the rotation of the motor, so that the screw 41 is driven in a direction which causes the movement of the piston to the right of the Figure, as indicated by the arrow 63. The annular chamber 49 also moves toward the right; it puts the pipe 37, connected to the pump, in communication with the pipe 56 which discharges into the volume 55 of the main chamber of the cylinder 35. In this case, a greater pressure force is applied on the front surface 57 of the piston; the latter then returns to the position of equilibrium described in FIG. 2A. If this equilibrium position corresponds to the predetermined programmed position, the motor 42 is stopped. This case corresponds, in fact, to the movement of the piston 6 downward, in FIG. 1.

FIG. 2C corresponds to the case where the means of commutation 52 have commanded the motor 42, so that the latter drives the screw 41 in a direction causing the movement of the piston to the left of the Figure, in the direction of the arrow 58. The annular chamber 49 also moves toward the left; its puts the volume 55 of the main chamber of the cylinder 35 in communication with the reservoir 39 of FIG. 2A, through pipes 56 and 40. The pressure then becomes stronger on the rear surface 59 of the piston 6, thus causing its movement toward the right of the Figure; this piston then returns to the equilibrium position described in FIG. 2A. The motor 42 is then stopped, if the commutation means 52 receives a zero signal, indicating that the momentary position of the piston corresponds to the predetermined programmed position. The movement of the piston to the right corresponds to the retreat of this piston in FIG. 1.

It is quite evident that the movements of the piston 14, as well as its position control, are comparable to what has just been described for the piston 6.

FIG. 3 represents schematically the electric control circuit of the position of the piston to the predetermined programmed position. This circuit includes, as has been indicated above, a comparator 64. This comparator receives, at an entrance 65, a signal corresponding to the predetermined programmed position; this position is that which the piston must reach; this signal is given by known means, not represented in the Figure. The comparator also receives, at an entrance 60, a signal coming from the outlet 24 of the opto-electronic detector 22 of the HEIDENHAIN coder 16 (FIG. 1). This signal, coming from the detector 24, indicates the momentary position of the piston 6. The signal difference, given at the outlet 53 of the comparator 64, is applied to the commutation means 52, as has been indicated above. The outlet of these commutation means is connected to a command entrance of the motor 42.

The electric control circuit of the position of the piston 14 of the jack 15, is constituted identically and will not be described in detail here.

The motor 42 can also receive, at a stop entrance 66, a stop command signal, coming from the outlet 33 (FIG. 1), for example, of control means 32. This signal permits stopping the motor when a pressure force, exceeding a predetermined threshold, is detected by the detector 26 (FIG. 1). The outlet 33 may also command the stopping of the pump 38, by application of a stop signal to an entrance 64 of the said pump 38 (FIG. 2A).

It is evident that the outlet 34 of the control means 32 can also command the stopping of the motor and of the pump commanding the jack 15.

The automatic press which has just been described permits fixing, with great precision, the positions of the first and second plate, in relation to the respective reference positions. Thus, the press of the present invention has the advantages mentioned above: it includes a control of the position of at least one of the plates, but also a control of the pressures exerted on the latter. It permits obtaining objects, for example, by the sintering of powders, while this sintering may be greater over a part of the object than over an opposite part. Means of heating, not shown, may surround the mold 31 containing the powder. This press may also be applied on welding machines, for bringing plates together.

The invention has been described with reference to a preferred embodiment. Obviously, modificatons and alterations will occur to others upon the reading and understanding of this specification. It is intended to include all such modifications and alterations insofar as they come within the scope of the appended claims or the equivalents thereof.

What is claimed is:

1. An automatic press comprising:

a first plate movable in translation parallel to a vertical axis, a hydraulic jack, of which a piston secured to the first plate commands the translational movement of the first plate to bring it into a predetermined position, referenced in relation to a fixed reference position, along the vertical axis, the jack being supported by a frame, a second plate which supports an object to be pressed, the second plate being situated facing the first plate, wherein the jack includes internal hydro-mechanical means for controlling the position of the first plate in relation to the predetermined position, and an opto-electronic means for indicating momentary positions of the first plate during its movement, the opto-electronic means being connected to the hydro-mechanical means for controlling the jack commanding the movement of the first plate, wherein the second plate is movable in translation parallel to said vertical axis, the second plate being secured to a piston of another hydraulic jack, the piston of the other jack commanding the movement of the second plate to bring it into another predetermined position, referenced in relation to the fixed reference position, the other jack being directly supported by said frame and including other internal hydro-mechanical means for controlling the position of the second plate in relation to the fixed reference position, other opto-electronic means, indicating the momentary positions of the second plate during its movement, being connected to the other control means of the other jack which commands the movement of the second plate, and wherein the first and second plates include, respectively, detectors of forces, giving, respectively, signals indicating forces exerted on the first and second plates during the pressing and during the distancing of the plates, the detectors being connected to means for control of the forces, the jacks being connected to the control means to stop movement of the plate for which the force indicated by the detector is greater than a predetermined limit force.

2. An automatic press comprising:

a press frame having a vertical axis extending therethrough;

a hydraulic jack secured to said frame;

a first plate secured to said hydraulic jack and movable along said frame vertical axis;

a second plate which supports an object meant to be pressed between said first and second plates;

a fixed reference position provided on said press frame, wherein the movements of said first and second plates are measured form said fixed reference position;

hydro-mechanical means for controlling the position of said first plate in relation to said fixed reference position;

opto-electronic means for indicating the momentary positions of said first plate during its movement, said opto-electronic means being connected to said hydro-mechanical means;

force detector means for detecting the amount of force exerted on said first plate both when said first plate is being moved towards said second plate and when said first plate is being moved away from said second plate;

control means for controlling the force exerted on said first plate both when said first plate is being moved toward said second plate and when said first plate is being moved away from said second plate and wherein said control means stops the movement of said first plate when the force indicated by said detector means is greater than a predetermined limit force;

a second hydraulic jack means for moving said second plate along the vertical axis, said second hydraulic jack being directly secured to said frame;

second hydro-mechanical means for controlling the position of said second plate in relation to said fixed reference position; and second opto-electronic means for indicating the momentary positons of said first plate during its movement, said opto-electronic means being connected to said second hydro-mechanical means.

* * * * *